US009493023B2

(12) United States Patent
Fukunaga et al.

(10) Patent No.: US 9,493,023 B2
(45) Date of Patent: Nov. 15, 2016

(54) HEAT-SENSITIVE TRANSFER RECORDING MEDIUM, PRODUCING METHOD THEREOF AND HEAT-SENSITIVE TRANSFER RECORDING METHOD

(71) Applicant: Toppan Printing Co., Ltd., Taito-ku, Tokyo (JP)

(72) Inventors: Godai Fukunaga, Taito-ku (JP); Takehito Yamato, Taito-ku (JP); Yasuo Sugishita, Taito-ku (JP); Yoko Hirai, Taito-ku (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

(21) Appl. No.: 14/448,992

(22) Filed: Jul. 31, 2014

(65) Prior Publication Data

US 2014/0340459 A1 Nov. 20, 2014

Related U.S. Application Data

(63) Continuation of application No. PCT/JP2013/000464, filed on Jan. 29, 2013.

(30) Foreign Application Priority Data

| | | |
|---|---|---|
| Feb. 10, 2012 | (JP) | 2012-027378 |
| Mar. 27, 2012 | (JP) | 2012-072321 |
| Mar. 27, 2012 | (JP) | 2012-072467 |
| Mar. 28, 2012 | (JP) | 2012-074341 |

(51) Int. Cl.
*B41M 5/42* (2006.01)
*B41M 5/44* (2006.01)

(52) U.S. Cl.
CPC ..... *B41M 5/42* (2013.01); *B41M 5/44* (2013.01); *B41M 2205/02* (2013.01);
(Continued)

(58) Field of Classification Search
CPC ..... B41M 5/40; B41M 5/42; B41M 5/44; B41M 2205/36; B41M 2205/38;
(Continued)

(56) References Cited

U.S. PATENT DOCUMENTS 6,140,037 A * 10/2000 Katoh ..... G03C 1/49863 430/531
2006/0046003 A1 3/2006 Hiroishi et al.
(Continued)

FOREIGN PATENT DOCUMENTS

CN 101052534 A 10/2007
JP 61-081962 U 5/1986
(Continued)

OTHER PUBLICATIONS

International Search Report dated Apr. 16, 2013 issued in Application No. PCT/JP2013/000464.
(Continued)

*Primary Examiner* — Sarah Al Hashimi
(74) *Attorney, Agent, or Firm* — Foley & Lardner LLP

(57) ABSTRACT

The heat-sensitive transfer recording medium of the invention is such that an equilibrium moisture absorption rate at 23° C./50% of an undercoating layer containing a water-soluble polymer as a main component is about 15% or less, preferably 13% or less, and more preferably, a mean value (α) of the surface roughness (root mean square deviation Sq) of the heat-resistant lubricating layer is about 0.05-0.40 μm, a mean value (β) of the surface roughness (root mean square deviation Sq) of the heat-resistant lubricating layer after being allowed to stand for 10 minutes at 150° C. is about 0.00-0.70 μm, and a difference between the mean value (α) and the mean value (β) is about 0.00-0.30 μm.

11 Claims, 1 Drawing Sheet

(52) U.S. Cl.
CPC ..... *B41M 2205/06* (2013.01); *B41M 2205/30* (2013.01); *B41M 2205/36* (2013.01); *B41M 2205/38* (2013.01)

(58) Field of Classification Search
CPC ..... B41M 2205/02; B41M 2205/06; B41M 2205/30
USPC ..... 347/221, 204, 171, 193
See application file for complete search history.

(56) References Cited

U.S. PATENT DOCUMENTS

| | | | | |
|---|---|---|---|---|
| 2008/0274310 | A1* | 11/2008 | Fukui et al. | 428/32.69 |
| 2014/0232808 | A1* | 8/2014 | Ono et al. | 347/221 |

FOREIGN PATENT DOCUMENTS

| | | | |
|---|---|---|---|
| JP | 2000-247049 | A | 9/2000 |
| JP | 2005-035122 | A | 2/2005 |
| JP | 2005-231354 | A | 9/2005 |
| JP | 2006-069198 | A | 3/2006 |
| JP | 2006-150956 | A | 6/2006 |
| JP | 2006-306017 | A | 11/2006 |
| JP | 2008-155612 | A | 7/2008 |

OTHER PUBLICATIONS

First Office Action dated Aug. 6, 2015 issued in Chinese Application No. 201380008108.9, with English translation.

* cited by examiner

FIG. 1
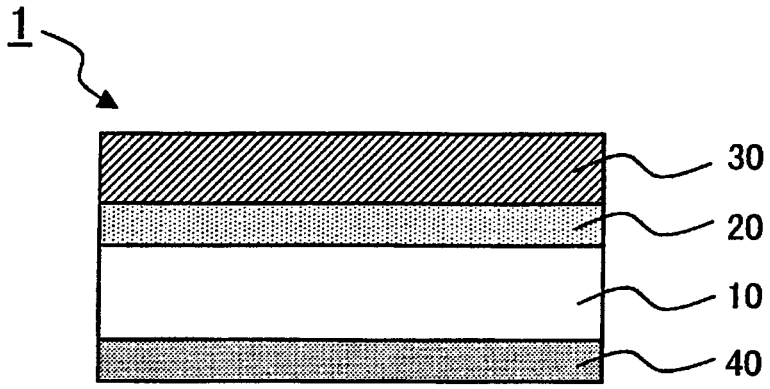
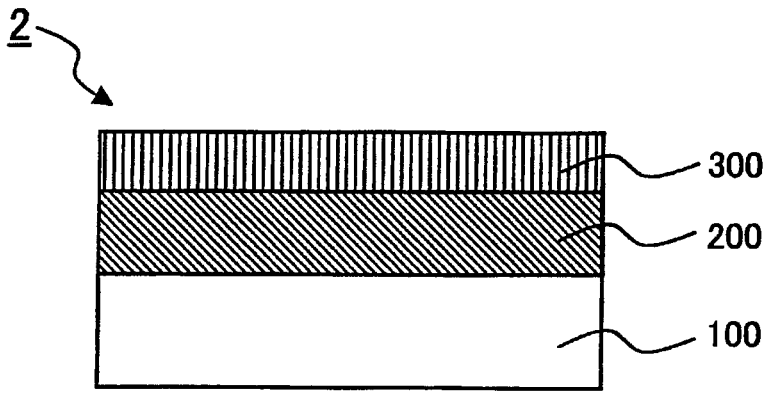
FIG. 2

HEAT-SENSITIVE TRANSFER RECORDING MEDIUM, PRODUCING METHOD THEREOF AND HEAT-SENSITIVE TRANSFER RECORDING METHOD

CROSS-REFERENCE TO RELATED PATENT APPLICATIONS

This application is a continuation application filed under 35 U.S.C. §111(a) claiming the benefit under 35 U.S.C. §§120 and 365(c) of PCT International Application No. PCT/JP2013/000464 filed on Jan. 29, 2013, which is based upon and claims the benefit of priority of Japanese Application No. 2012-027378 filed on Feb. 10, 2012; Japanese Application No. 2012-072321 filed on Mar. 27, 2012; Japanese Application No. 2012-072467 filed on Mar. 27, 2012; Japanese Application No. 2012-074341 filed on Mar. 28, 2012; the entire contents of which are hereby incorporated by reference in their entireties.

BACKGROUND OF THE INVENTION

1. Technical Field

The invention relates to a heat-sensitive transfer recording medium for use in heat-sensitive transfer-type printers, a producing method thereof, and a heat-sensitive transfer recording method, and more particularly, to a heat-sensitive transfer recording medium wherein a heat-resistant lubricating layer is provided on one surface of a base material, and an undercoating layer and a dye layer are successively formed on the other surface of the base material, its producing method, and a heat-sensitive transfer recording method.

2. Technical Background

Generally, a heat-sensitive transfer recording medium called a thermal ribbon refers to an ink ribbon used in heat-sensitive transfer-type printers, and is provided with a heat-sensitive transfer layer on one surface of a base material and also with a heat-resistant lubricating layer (a back coat layer) on the other surface of the base material. Here, the heat-sensitive transfer layer is a layer of an ink which is sublimated (sublimation transfer type) or melted (melting transfer type) by application of heat generated from a thermal head of a printer to allow transfer to a transfer object side.

The sublimation transfer type system among the heat-sensitive transfer type systems has now been widely applied to self-service printing for digital cameras, cards such as an identification card, output objects for amusements and so on. This is because of the capability of forming various images in full color along with the availability of high-performance printers. With such a diversity of uses, demands for downsizing, speed-up, reduction in cost, or durability of printed objects to be obtained are growing. In recent years, a heat-sensitive transfer recording medium having a plurality of heat-sensitive transfer layers wherein a plurality of protect layers etc. for giving durability to a printed object are provided on the same side of a base sheet so as not to overlap has been in use.

In this surroundings, as printing speed of printers increases along with diversification of uses and increases in popularity, a problem has arisen in that sufficient printing density cannot be obtained with conventional heat-sensitive transfer recording media. Therefore, in order to increase performance, including transfer sensitivity, an attempt has been made to increase transfer sensitivity in the course of printing by thinning a heat-sensitive transfer recording medium. Nevertheless, problems are involved in that wrinkles are caused to occur by the action of heat or pressure etc., during the fabrication of heat-sensitive transfer recording media or during printing, or breakages may occur in some cases.

In addition, an attempt has been made to improve a printing density or transfer sensitivity during printing by increasing a ratio of dye/resin (dye/binder) in a dye layer of a heat-sensitive transfer recording medium. To increase the dye causes not only increases in cost, but also the transfer (offset) part of a dye to a heat-resistant lubricating layer of a heat-sensitive transfer recording medium during the course of winding in a fabrication step and then to re-transfer (re-offset) the once transferred dye to a dye layer of other color or a protective layer during subsequent re-winding. If this contaminated layer is thermally transferred to an object to be transferred thereto, a hue different from an intended color may appear, or so-called scumming may occur.

Further, an attempt has been made to increase in power not only at a heat-sensitive transfer recording medium side, but also at the time of image formation at a printer side. However, this causes not only an increase in power consumption, but also a shortage of life of a thermal head of the printer, along with a tendency that there occurs so-called abnormal transfer, in which a dye layer and an object to be transferred thereto are fused together. In order to prevent the abnormal transfer, if a large amount of a release agent is added to the dye layer or the object to be transferred thereto, image bleeding or scumming occurs.

For solving these demands, for example, in Patent Literature 1, there has been proposed a thermal transfer sheet having, between a base material and a dye layer, an adhesion layer (an undercoating layer) containing a polyvinylpyrrolidone resin and a modified polyvinylpyrrolidone resin.

Further, Patent Literature 2 has proposed, in order to solve not only the problem of a lack of transfer sensitivity, but also the problem of local matting on a print surface, a thermal transfer sheet having an undercoating layer consisting of a copolymer resin of vinylpyrrolidone and vinyl acetate and ultrafine particles of a colloidal inorganic pigment.

As transfer sensitivity increases like this, the dye layer can be made thinner and the total amount of dyes reduces, thus leading to cost reduction. Nevertheless, problems are involved in that a print failure occurs by means of heat or pressure etc., upon printing on the heat-sensitive transfer recording medium or breakage occurs in some cases.

In case where the lubricity of a heat-resistant lubricating layer is insufficient, the wrinkles occurring during the printing on a heat-sensitive transfer recording medium may be caused through the sticking between a base material and a thermal head. In addition, if there is a significant difference between the lubricities of a heat-resistant lubricating layer at low-power printing and at high-power printing, e.g. in case where there are both a print area and a non-print area on the same image, the sticking may occur caused by a difference in friction between the thermal head and the heat-resistant lubricating layer at both areas. Hence, as the dye layer is made thinner, the heat-sensitive transfer recording medium is demanded to have, especially, a high heat resistance.

To solve these problems, Patent Literature 3 has proposed a method wherein a metallic soap and a filler are added to a heat-resistant lubricating layer along with a silicone modified resin to improve lubricity at the time of high-energy printing to prevent the occurrence of wrinkles during printing.

PATENT LITERATURE

[PTL1] Japanese Patent Application Publication No. 2005-231354

[PTL2] Japanese Patent Application Publication No. 2008-155612

[PTL3] Japanese Patent Application Publication No. 2006-306017

SUMMARY OF THE INVENTION

However, when the heat-sensitive transfer recording medium proposed in Patent Literature 1 was subjected to printing by use of an existing sublimation transfer-type high-speed printer, transfer sensitivity in printing was too low to reach a satisfactory level although abnormal transfer was not confirmed. Further, an image quality failure occurred by introducing an adhesive layer, in which the print surface suffered partial matting with respect to a high density black area when a black image was formed.

When printing was likewise carried out using the heat-sensitive transfer recording medium proposed in Patent Literature 2, an image quality failure was still confirmed although transfer sensitivity in printing was high enough to reach a satisfactory level.

In this way, where a current sublimation transfer-type high-speed printer is used, transfer sensitivity in printing can be obtained by introducing the undercoating layer prior art techniques. However, existing circumstances are such that no heat-sensitive transfer recording medium has been found, which overcomes the problem of partial matting on a print surface at high density areas when a black image is formed.

Further, where the heat-sensitive transfer recording medium proposed in Patent Literature 3 and the heat-resistant lubricating layer described in the heat-sensitive transfer recording medium proposed in Patent Literatures 1, 2 were used in combination, a printing failure due to the wrinkles caused at the time of printing was slightly improved when comparing with the case using, singly, the heat-sensitive transfer recording media proposed in Patent Literatures 1, 2, but cannot be prevented sufficiently well.

Thus, where current sublimation transfer-type high-speed printers are used, transfer sensitivity in printing can be obtained by introducing the undercoating layer in prior-art techniques. However, a heat-sensitive transfer recording medium has never been found in which when a black image is formed, a problem of partial matting on the print surface with respect to high density black areas is adequately well solved. In addition, the image failure caused the wrinkles occurring during printing cannot be prevented satisfactorily.

The invention has been made in view of those circumstances and has as its object the provision of a heat-sensitive transfer recording medium which has a relatively higher transfer sensitivity in high-speed printing, can relatively reduce an image quality failure occurring in high density areas, i.e., a phenomenon wherein the surface of a printed object is partially matted, and can relatively prevent a print failure caused by wrinkles occurring during printing.

Measure for Improving Performance

For attempting to improve performance under these circumstances, the invention is characterized by having the following configuration.

(1) A heat-sensitive transfer recording medium comprising a base material, a heat-resistant lubricating layer formed on one surface of the base material, an undercoating layer formed on the other surface of the base material, and a dye layer formed on a surface, opposite to a surface facing to the base material, of the undercoating layer, characterized in that the undercoating layer contains a water-soluble polymer as a main component, and an equilibrium moisture absorption rate under conditions of a temperature of 23° C. and a humidity of 50% is 15% or less.

(2) The heat-sensitive transfer recording medium as defined in the above (1), characterized in that the equilibrium moisture absorption rate of the undercoating layer under conditions of a temperature of 23° C. and a humidity of 50% is 13% or less.

(3) The heat-sensitive transfer recording medium as defined in the above (1) or (2), characterized in that an average $\alpha$ of surface roughness (root-mean-square deviation Sq) of the heat-resistant lubricating layer is 0.05-0.40 μm, an average $\beta$ of surface roughness (root-mean-square deviation Sq) of the heat-resistant lubricating layer after standing under conditions of 150° C. and 10 minutes is 0.00-0.70 μm, and a difference between the average $\alpha$ and the average $\beta$ is 0.00-0.30 μm.

(4) The heat-sensitive transfer recording medium as defined in any of the above (1) to (3), characterized in that a coating amount of the undercoating layer after drying is 0.05-0.30 g/m$^2$.

(5) The heat-sensitive transfer recording medium as defined in any of the above (1) to (4), characterized in that, at least one layer on a side of an object to be transferred thereto is formed by an aqueous coating solution.

(6) A method for producing a heat-sensitive transfer recording medium of a type which is used for a transfer object wherein at least one layer at a side to be transferred of the transfer object is formed with an aqueous coating solution and which includes a film-shaped or sheet-shaped base, a heat-resistant lubricating layer formed on one surface of the base, an undercoating layer formed on the other base surface opposite to the heat-resistant lubricating layer, and a dye layer formed on the undercoating layer, characterized by coating an undercoating layer-forming solution containing a water-soluble polymer as a main component onto a base surface opposite to the heat-resistant layer; and drying the undercoating layer-forming solution in such a way that an equilibrium moisture absorption rate under conditions of a temperature of 23° C. and a humidity of 50% is 15% or less.

(7) The method as defined in the above (6), characterized in that the undercoating layer is dried in such a way that the equilibrium moisture absorption rate under conditions of a temperature of 23° C. and a humidity of 50% is 13% or less.

(8) The method as defined in the above (6) or (7), characterized in that the undercoating layer formatting solution containing a water-soluble polymer as a main component is coated on the base surface opposite to the heat-resistant layer in a dry coating amount of from not less than 0.05 g/m$^2$ to not larger than 0.30 g/m$^2$, and subsequently the undercoating layer forming solution is dried.

(9) A heat-sensitive transfer recording method, characterized in that the heat-sensitive transfer recording medium defined in any of the above (1) to (5) is provided, and a dye contained in the dye layer is sublimated by application of heat to transfer to an transfer object.

Description of Representative Embodiments

The heat-sensitive transfer recording medium of the invention is configured such that an equilibrium moisture absorption rate of the undercoating layer containing a water-soluble polymer as a main component under conditions of 23° C./50% is 15% or less, preferably 13% or less, and that preferably, an average $\alpha$ of surface roughness (root-mean-square deviation Sq) of the heat-resistant lubricating layer is 0.05-0.40 μm, an average $\beta$ of surface roughness (root-mean-square deviation Sq) of the heat-resistant lubricating layer after standing under conditions of 150° C. and 10 minutes is 0.00-0.70 μm, and a difference between the average α and the average β is 0.00-0.30 μm. Accordingly, even if a current sublimation transfer type high-speed printer is used, transfer sensitivity in high-speed printing is high, and there can be obtained prints which can relatively reduce occurrences of a phenomenon where the surface thereof is locally matted and a print failure caused by wrinkles occurs during printing.

BRIEF DESCRIPTION OF THE DRAWINGS

[FIG. 1] is a sectional side view of a heat-sensitive transfer recording medium according to an embodiment based on the invention.

[FIG. 2] is a sectional side view of a transfer object according to an embodiment based on the invention.

DETAILED DESCRIPTION OF THE PREFERRED EMBODIMENTS

Mode for Carrying Out an Embodiment of the Invention

A heat-sensitive transfer recording medium of an example of the invention has, as shown in FIG. 1, such a configuration that a heat-resistant lubricating layer (40) imparting lubricity to a thermal head is provided on one surface of a base material (10), an undercoating layer (20) and a dye layer (30) are successively formed on the other surface of the base material (10).

As the base material (10) which is required to have a heat resistance and strength sufficient not to allow deformation by softening by means of thermal pressure in the course of thermal transfer, there are usable, for example, films of synthetic resins such as polyethylene terephthalate, polyethylene naphthalate, polypropylene, cellophane, acetate, polycarbonate, poly sulfone, polyimide, polyvinyl alcohol, aromatic polyamide, aramid and polystyrene, and papers such as condenser paper and paraffin paper and the like, which are used singly or in combination as a composite material thereof. Among them, polyethylene terephthalate film is preferred in view of physical properties, processability, costs and so on.

While taking operability and processability into account, a usable thickness of the base material (10) is within a range of from not less than 2 μm to not larger than 50 μm may be used. In view of handleability properties such as transfer adaptability and processability, the thickness is preferably within a range of about not less than 2 μm to not larger than 9 μm.

The base material (10) may be subjected to adhesion treatment on the surface on which the heat-resistant lubricating layer (40) and/or the undercoating layer (20) are to be formed thereon. For the adhesion treatment, there may be used prior-art techniques such as of corona treatment, flame treatment, ozone treatment, ultraviolet treatment, irradiation treatment, surface roughening treatment, plasma treatment and primer treatment, which may be used in combination of two or more. In the invention, it is effective to enhance adhesion between the base material and the undercoating layer, for which a polyethylene terephthalate film subjected to primer treatment is preferred from the standpoint of costs.

Next, the heat-resistant lubricating layer (40) should be such that an average α of surface roughness (root-mean-square deviation Sq) of the heat-resistant lubricating layer 40 is about 0.05-0.40 μm, an average β of surface roughness (root-mean-square deviation Sq) of the heat-resistant lubricating layer 40 after standing under conditions of 150° C. and 10 minutes is about 0.00-0.70 μm, and a difference between the average α and the average β is within a range of about 0.00-0.30 μm.

The root-mean-square deviation Sq can be measured by various methods and was measured with a laser microscope, i.e. a non-contact measuring method which is unlikely to be affected by the underlying layer and ensures measurement of a micro shape.

As such a device, confocal scanning lase microscope OLS4000 (manufactured by Olympus corporation) was used. With measurement with a laser microscope, resolving power depends on numerical aperture of an objective lens. On the other hand, in order to mitigate variability, a wide range of measurement should preferably be taken. A 50-power objective lens, which has the best balance between the numerical aperture and the measurement range, was selected, after which ten points were measured at random. For information processing, a gradient alone was corrected, followed by averaging values of Sq obtained under cutoff-free conditions to obtain an Sq value of the heat-resistant lubricating layer 40.

It will be noted that the surface roughness of the heat-resistant lubricating layer 40 can be evaluated by root-mean-square waviness Wq. It is preferred that an average α of the root-mean-square waviness Wq is about 0.05-0.90 μm (that is, within a range from not less than about 0.05 μm to not larger than 0.90 μm), an average β of the surface roughnesses (the root-mean-square wavinesses Wq) of the heat-resistant lubricating layer 40 after standing under conditions of a temperature of 150° C. and 10 minutes is about 0.00-1.40 μm (that is, within a range from not less than about 0.00 μm to not larger than 1.40 μm), and a difference between the average α and the average β is about 0.00-0.50 μm (that is, within a range from not less than about 0.00 μm to not larger than 1.40 μm).

The root-mean-square waviness Wq can be measured by many methods. In practice, using a laser microscope displacement meter, root-mean-square wavinesses of an waviness profile obtained using a profile filter of a cutoff value λf of 1.25 mm and λc of 0.25 mm were calculated and measurement was made at n=10, thereby providing an average. Further, the Wq value of the heat-resistant lubricating layer 40 is also calculated in the same manner as set out above after standing in an environment of 150° C. and 10 minutes, from which a difference between before and after the standing in the environment of 150° C. and 10 minutes can be calculated.

Further, the Sq value of the heat-resistant lubricating layer 40 was also calculated in the same manner as set forth above after standing in an environment of 150° C. and 10 minutes, and a difference between before and after standing in the environment of 150° C. and 10 minutes was calculated.

Since the heat-resistant lubricating layer 40 has a given degree of irregularity, an area of contact between the heat-resistant lubricating layer 40 and the thermal head becomes small and thus, the friction therebetween lowers to obtain lubricity, thereby enabling prevention of a print failure. In the invention, the value of the average α of the surface roughness (the root-mean-square deviation Sq) of the heat-resistant lubricating layer 40 is about 0.05 μm-0.40 μm. If the root-mean-square deviation Sq of the heat-resistant lubricating layer 40 is about 0.05 μm or less, a nearly smooth surface is realized and increases the friction with the thermal head, thereby causing a print failure. On the other hand, if the root-mean-square deviation Sq of the heat-resistant lubricating layer 40 before printing is about 0.40 μm or over, the degree of irregularity becomes excessively large to cause non-uniform thermal transmission from the thermal head, resulting in density irregularity appearing on a printed object.

Further, if a certain degree of irregularity can be kept from low-energy printing to over high-energy printing, stable lubricity can be obtained during the course of from at low-energy printing to high-energy printing. Even when there are printing areas and non-printing areas on the same image, no difference in lubricity develops between both, thereby enabling the occurrence of wrinkles to be prevented. Accordingly, if the difference between the averages of the root-mean-square deviations Sq before and after standing the heat-resistant lubricating layer in an environment at 150° C. for 10 minutes is within a range of about 0.00-0.30 μm, no relatively significant difference in surface irregularity between at low-energy printing and at high-energy printing develops, thus enabling the occurrence of wrinkles to be prevented.

In order to satisfy the above-described range of the surface roughness, there is a need for regulating the irregularity of the heat-resistant lubricating layer (40).

The heat-resistant lubricating layer 40 can be formed, for example, by formulating a resin serving as a binder, a functional additive for imparting a releasing property or lubricity, a filler, a curing agent, a solvent and so on as necessary to prepare a coating solution to form (for forming) the heat-resistant lubricating layer, followed by coating and drying.

The dry coating amount of the heat-resistant lubricating layer (40) is conveniently at about not less than 0.1 g/m$^2$ to not larger than about 2.0 g/m$^2$. The dry coating amount of the heat-resistant lubricating layer (40) used herein means a solid content left after coating with the coating solution and drying. Likewise, the dry coating amount of the undercoating layer (20) and the dry coating amount of the dye layer (30) appearing hereinafter, respectively, indicate a solid content left after coating with the coating solution and drying.

As an example of the heat-resistant lubricating layer, there may be used polyvinyl butyral resin, polyvinyl acetoacetal resin, polyester resin, vinyl chloride-vinyl acetate copolymer, polyether resin, polybutadiene resin, acrylic polyol, polyurethane acrylate, polyester acrylate, polyether acrylate, epoxy acrylate, nitrocellulose resin, cellulose acetate resin, polyamide resin, polyamide-imide resin, polyimide resin, polycarbonate resin and so on.

Similarly, as a functional additive, there may be used, for example, natural waxes such as animal waxes and plant waxes, synthetic waxes such as synthetic hydrocarbon waxes, aliphatic alcohol and acid waxes, fatty acid ester and glycerite waxes, synthetic ketone waxes, amine and amide waxes, chlorinated hydrocarbon waxes and alpha olefin waxes, and surfactants including higher fatty acid esters, such as butyl stearate and ethyl oleate, metal salts of higher fatty acids such as sodium stearate, zinc stearate, calcium stearate, potassium stearate and magnesium stearate, phosphate esters such as long-chain alkyl phosphate esters, polyoxyalkylene alkyl aryl ether phosphate esters or polyoxyalkylene alkyl ether phosphate esters.

As a filler, there may be used talc, silica, magnesium oxide, zinc oxide, calcium carbonate, magnesium carbonate, kaolin, clay, silicone particles, polyethylene resin particles, polypropylene resin particles, polystyrene resin particles, polymethyl methacrylate resin particles, polyurethane resin particles and the like.

As a curing agent, there may be used isocyanates such as tolylene diisocyanate, triphenylmethane triisocyanate and tetramethylxylene diisocyanate, and derivatives thereof.

Next, the undercoating layer (20) is formed by coating with and drying a coating solution which contains a water-soluble polymer as a main component. Further, it is needed that an equilibrium moisture absorption rate under 23° C./50% be 15% or less. The main component used herein means that unless the effects of the invention is impaired, other types of components may also be added aside from the water-soluble polymer and that the total of water-soluble polymers is present at over 50 mass % as a whole of the undercoating layer being form, preferably at not less than 80 mass %.

Examples of the water-soluble polymers used for the undercoating layer may include polyvinyl alcohol and modified copolymers/copolymers thereof, polyvinylpyrrolidone and modified copolymers/copolymers thereof, starch, gelatin, methylcellulose, ethyl cellulose, carboxymethyl cellulose and the like.

Of these, those which are able to impart relatively good adhesion between a base material and a dye layer to ensure a high printing density are polyvinyl alcohol and its modified copolymers/copolymers and polyvinylpyrrolidone and its modified copolymer/copolymer.

In the invention, it is preferred that an equilibrium moisture absorption rate of the undercoating layer at 23° C./50% be about 15% or less, preferably 13% or less. If the equilibrium moisture absorption rate at 23° C./50% is about 15% or less, preferably 13% or less, the occurrence of an image failure can be reduced or prevented, in which the surface of the print object is partially matted with respect to the high density black areas when a black image is formed. The mechanism of the occurrence of matting is not known. However, it is supposed that if the moisture absorption rate is larger than about 15%, then water contained in the undercoating layer is vaporized or expanded upon printing to permit partial sticking between the dye layer and the print surface. This causes a partial difference in hue, resulting in partial matting at the print surface. Alternatively, vaporized or expanded water may serve to form fine irregularities and thus, light scattering occurs thereby causing local matting.

It will be noted that the lower limit of the equilibrium moisture absorption rate under 23° C./50% is not limited particularly and the range of the equilibrium moisture absorption rate under 23° C./50% in the invention may be a range available depending on the type of resin to be used and so on, and a range where a high printing density can be obtained in high-speed printing.

The equilibrium moisture absorption rate under 23° C./50% is 8-10% for polyvinyl alcohol and modified copolymer/copolymer, 25-30% for polyvinylpyrrolidone and modified copolymers/copolymers, about 30% for carboxymethyl cellulose, and 10-16% for starch. Although use of polyvinyl alcohol and modified copolymers/copolymers is preferred, the equilibrium moisture absorption rate of the undercoating layer may be 15% or less, preferably 13% or less, and polyvinyl alcohol and polyvinylpyrrolidone may be mixed arbitrarily such that the equilibrium moisture absorption rate is set at 15% or less, preferably at 13% or less.

It will be noted that the equilibrium moisture absorption rate is an index, based on the standards of ISO, showing a degree of moisture absorption of a specimen at a temperature of 23±1° C. and a humidity of 50±2% RH, and was measured according to the following method. Approximately 5 g of materials used for the undercoating layer were weighed in an aluminum cup having a bottom diameter of 5.3 cm, followed by drying at 105° C. for 3 hours. This was allowed to stand in a thermostatic humidistat of 23° C./50% RH until it reached a constant mass, followed by measuring weight (W) thereof and drying at 105° C. for 3 hours to measure an absolute dry mass (W0). The equilibrium moisture absorption rate was calculated according to the following equation.

$$\text{Equilibrium moisture absorption rate (mass \%)} = \{(W-W0)/W0\}\times 100$$

As a polyvinyl alcohol, mention is made, for example, of polyvinyl alcohols such as Kuraray POVAL PVA-235 (manufactured by KURARAY Company), Kuraray POVAL PVA-117 (manufactured by KURARAY Company), Kuraray POVAL PVA-124 (manufactured by KURARAY Company), GOHSENOL KH-20 (manufactured by Nippon Synthetic Chemical Industry Company) and GOHSENOL N-300 (manufactured by Nippon Synthetic Chemical Industry Company), GOHSEFIMER Z-200 and Z-320 (manufactured by Nippon Synthetic Chemical Industry Company) which are reactive acetoacetylated polyvinyl alcohols having an acetoacetyl group, aqueous polyvinyl acetal S-LEC KX series (manufactured by Sekisui Chemical Company) and S-LEC KW series (manufactured by Sekisui Chemical Company) wherein part of the alcohol groups of polyvinyl alcohol is acetal-modified, and the like.

As a polyvinylpyrrolidone, mention is made of a homopolymer of vinylpyrrolidone such as N-vinyl-2-pyrrolidone or N-vinyl-4-pyrrolidone or the like, or a copolymer thereof. Further, there may be mentioned a modified polyvinylpyrrolidone resin. The modified polyvinylpyrrolidone resin is a copolymer of N-vinylpyrrolidone monomer and other type of monomer. It will be noted that the mode of copolymerization is not particularly limited and includes random copolymerization, block copolymerization or graft copolymerization. The above-mentioned N-vinylpyrrolidone monomer means an N-vinylpyrrolidone (N-vinyl-2-pyrrolidone, N-vinyl-4-pyrrolidone or the like) and a derivative thereof. As such a derivative, mention is made, for example, of those having a substituent group at the pyrrolidone ring, such as N-vinyl-3-methylpyrrolidone, N-vinyl-5-methylpyrrolidone, N-vinyl-3,3,5-trimethylpyaolidone, N-vinyl-3-benzilpyrrolidone and so on.

Monomer components which copolymerize with N-vinylpyrrolidone monomers include vinyl-polymerizable monomers indicated below. Examples include (metha)acryl monomers such as (metha)acrylic acid, (metha)acrylate, methyl(metha)acrylate, ethyl(metha)acrylate and isopropyl (metha)acrylate, unsaturated carboxylic acids such as fumaric acid, maleic acid and itaconic acid, ethylene, propylene, vinyl chloride, vinyl acetate, vinyl alcohol, styrene, vinyl toluene, divinylbenzene, vinylidene chloride, tetrafluoroethylene, vinylidene fluoride and the like.

The dry coating amount of the undercoating layer (20) is not necessarily limited and is preferably within a range from not less than 0.05 g/m$^2$ to not larger than 0.30 g/m$^2$. At less than 0.05 g/m$^2$, there is concern that a problem may be involved in adhesion with a base material or dye layer because transfer sensitivity becomes insufficient in high-speed printing owing to the degradation of the undercoating layer during lamination of the dye layer. On the other hand, over 0.30 g/m$^2$, the lowering of transfer sensitivity of the heat-sensitive transfer recording medium itself is affected, with concern that the transfer sensitivity becomes insufficient in high-speed printing.

Further, for the undercoating layer or coating solution for the formation of the undercoating layer, there may be used known additives, such as ultrafine particles of colloidal inorganic pigments, isocyanate compounds, silane coupling agents, dispersants, viscosity modifiers and stabilizing agents, within ranges not impairing such performances as set forth before.

It will be noted that ultrafine particles of colloidal inorganic pigments are conventionally known ones including, for example, silica (colloidal silica), alumina or alumina hydrates (alumina sol, colloidal alumina, cationic oxide of aluminum or hydrate thereof, Pseudo-Boehmite, etc.), aluminum silicate, magnesium silicate, magnesium carbonate, magnesium oxide, titanium oxide, and so on.

Next, the dye layer (30) may be a hitherto known counterpart and is formed, for example, by formulating a thermal transition dye, a binder, a solvent and so on to prepare a coating solution for forming dye layer, followed by coating and drying. The dry coating amount of the dye layer (30) is conveniently about 1.0 g/m$^2$. It will be noted that the dye layer may be formed of a single layer of one color, or a plurality of dye layers containing dyes having different hues may be successively formed on the same surface of the same base material.

The thermal transition dye is a dye which is transferred by melting, diffusion or sublimation by means of heat. For example, mention is made of solvent yellows 56, 16, 30, 93, 33, disperse yellows 201, 231, 33, etc., for a yellow component. As a magenta component, mention is made of C.I. disperse violet 31, C.I. solvent red 60, C.I. disperse violet 26, C.I. solvent red 27, or C.I. solvent red 19, etc. As a cyan component, mention is made of C.I. disperse blue 354, C.I. solvent blue 63, C I. solvent blue 36, C.I. solvent blue 266, C.I. disperse blue 257, or C.I. disperse blue 24, etc. As a black dye, usual practice is to make color matching by combination of the dyes indicated above.

Usable resins contained in the dye layer (30) may be any of hitherto known resin binders although not particularly limited, including cellulose resins, such as ethyl cellulose, hydroxyethyl cellulose, ethylhydroxy cellulose, hydroxypropyl cellulose, methylcellulose and acetylcellulose, vinyl resins such as polyvinyl alcohol, polyvinyl acetate, polyvinyl butyral, polyvinyl acetal, polyvinylpyrrolidone and polyacrylamide, polyester resins, styrene-acrylonitrile copolymers, phenoxy resins and so on.

The formulation ratio of the dye to the resin of the dye layer (30) is preferably such that (dye)/(resin) is about 10/100 to about 300/100 on a mass basis. This is for the reason is that if the ratio of (dye)/(resin) is less than 10/100, the dye may be so small in amount that the sensitivity of color development becomes insufficient and a good heat-sensitive transfer image cannot be obtained. If this ratio exceeds 300/100, the solubility of the dye relative to the resin may lower extremely, under which when the heat-sensitive transfer recording medium is formed, storage stability deteriorates, with the likelihood that the dye segregation occurs. Further, the dye layer may further contain known additives such as an isocyanate compound, a silane coupling agent, a dispersant, a viscosity adjusting agent and a stabilizing agent.

It will be noted that all of the heat-resistant lubricating layer (40), the undercoating layer (20) and the dye layer (30) can be formed by coating with hitherto known coating methods and drying. For an example of the coating methods, mention is made of gravure coating method, screen printing method, spray coating method, and reverse roll coat method.

The method for producing a heat-sensitive transfer recording medium of the invention is a method for producing a heat-sensitive transfer recording medium of a type which is used for a transfer object wherein at least one layer at a side to be transferred of the transfer object is formed with an aqueous coating solution and which includes a film-shaped or sheet-shaped base, a heat-resistant lubricating layer formed on one surface of the base, an undercoating layer formed on the other base surface opposite to the heat-resistant lubricating layer, and a dye layer formed on the undercoating layer, characterized by coating an undercoating layer-forming solution containing a water-soluble polymer as a main component onto a base surface opposite to the heat-resistant layer, and drying the undercoating layer-forming solution in such a way that an equilibrium moisture absorption rate under conditions of a temperature of 23° C. and a humidity of 50% is 15% or less preferably 13% or below.

On this occasion, the base surface opposite to the heat-resistant lubricating layer is coated with the undercoating layer-forming solution containing a water-soluble polymer as a main component such that a dry coating amount of the undercoating layer-forming solution is from not less than 0.05 g/m$^2$ to not larger than 0.30 g/m$^2$. Preferably, the undercoating layer-forming solution is dried to have an equilibrium moisture absorption rate of 13% or less under conditions of a temperature of 23° C. and a humidity of 50%.

The heat-sensitive transfer recording method is characterized in that the above heat-sensitive transfer recording medium is provided, and the dye contained in the dye layer is sublimated by application of heat to transfer to a transfer object as shown in FIG. 2.

EXAMPLE 1

Materials used in the respective examples of the invention and the respective comparative examples are indicated below. It will be noted that "parts" appearing in the sentences is on mass basis unless otherwise indicated. In addition, the invention should not be construed as limited to the following representative examples.

<Preparation of a Base Material Having a Heat-Resistant Lubricating Layer>

As a base material, a 4.5 μm thick polyethylene terephthalate film having one surface subjected to easy-to-adhesion treatment was used. A non-easy-to-adhesion treatment surface was coated with a coating solution-1 for heat-resistant lubricating layer having the following composition according to a gravure coating method in a dry coating amount of 0.5 g/m$^2$, followed by drying at 100° C. for one minute, thereby obtaining a base material having the heat-resistant lubricating layer.

| <Coating solution-1 for heat-resistant lubricating layer> | |
|---|---|
| silicone acrylate (US-350 of TOAGOSEI CO., LTD.) | 50.0 parts |
| MEK | 50.0 parts |

EXAMPLE 1

An undercoating layer coating solution-1 having the following composition was coated onto an easy-to-adhesion treatment surface of the base material having a heat-resistant lubricating layer by a gravure coating method in a dry coating amount of 0.20 g/m$^2$, followed by drying at 100° C. for two minutes to form an undercoating layer. Subsequently, a dye layer coating solution 1 having the following composition was coated onto the undercoating layer by a gravure coating method in a dry coating amount of 0.70 g/m$^2$, followed by drying 90° C. for one minute to form a dye layer thereby obtaining a heat-sensitive transfer recording medium of Example 1. In Example 1, the averages α and β of the root-mean-square deviation Sq of the heat-resistant lubricating layer 40 were at α=0.057 and β=0.072, respectively. The equilibrium moisture absorption rate of the undercoating layer at 23° C./50% was 8%.

| <Undercoating layer coating solution-1> | |
|---|---|
| Polyvinyl alcohol | 5.00 parts |
| pure water | 57.0 parts |
| Isopropyl alcohol | 38.0 parts |

| <Dye layer coating solution> | |
|---|---|
| C. I. solvent blue-63 | 6.0 pars |
| Polyvinyl acetal resin | 4.0 parts |
| Toluene | 45.0 parts |
| Methyl ethyl ketone | 45.0 parts |

EXAMPLE 2

A heat-sensitive transfer recording medium of Example 2 was obtained in the same way as Example 1 except that the undercoating layer of the heat-sensitive transfer recording medium prepared in Example 1 was formed using an undercoating layer coating solution-2 having the following composition. In Example 2, average values α and β of the root-mean-square deviation Sq of the heat-resistant lubricating layer 40 were at α=0.058 and β=0.068, respectively. The equilibrium moisture absorption rate of the undercoating layer at 23° C./50% was 14%.

| <Undercoating layer coating solution-2> | |
|---|---|
| Polyvinyl alcohol | 3.00 parts |
| Polyvinylpyrrolidone | 2.00 parts |
| Pure water | 57.0 parts |
| Isopropyl alcohol | 38.0 parts |

EXAMPLE 3

A heat-sensitive transfer recording medium of Example 3 was obtained in the same way as Example 1 except that, in the heat-sensitive transfer recording medium prepared in Example 1, the undercoating layer was coated and dried in a dry coating amount of 0.03 g/m$^2$. In Example 3, average values α and β of the root-mean-square deviation Sq of the heat-resistant lubricating layer 40 were at α=0.060 and β=0.070, respectively.

EXAMPLE 4

A heat-sensitive transfer recording medium of Example 4 was obtained in the same way as Example 1 except that, in the heat-sensitive transfer recording medium prepared in Example 1, the undercoating layer was coated and dried in a dry coating amount of 0.035 g/m$^2$. In Example 4, average values α and β of the root-mean-square deviation Sq of the heat-resistant lubricating layer 40 were at α=0.058 and β=0.077, respectively.

EXAMPLE 5

A heat-sensitive transfer recording medium of Example 5 was obtained in the same way as Example 1 except that the heat-resistant lubricating layer 40 in the heat-sensitive transfer recording medium prepared in Example 1 was formed using a heat-resistant lubricating layer coating solution-2. In Example 5, average values α and β of the root-mean-square deviation Sq of the heat-resistant lubricating layer 40 were at α=0.175 and β=0.265, respectively.

| <Heat-resistant lubricating layer coating solution-2> | |
|---|---|
| Acrylic polyol resin (solid content 50%) | 20 parts |
| Phosphate ester melting point 15° C. | 1.5 parts |
| Phosphate ester melting point 70° C. | 1.5 parts |
| Zinc stearate melting point 115-125° C. | 2 parts |
| Talc particle size 1.0 μm | 1 part |
| Talc particle size 2.5 μm | 1 part |
| 2,6-Tolylene diisocyanate prepolymer | 5 parts |
| Toluene | 49.5 parts |
| Methyl ethyl ketone | 20 parts |
| Ethyl acetate | 5 parts |

EXAMPLE 6

A heat-sensitive transfer recording medium of Example 5 was obtained in the same way as Example 1 except that the heat-resistant lubricating layer 40 in the heat-sensitive transfer recording medium prepared in Example 1 was formed using a heat-resistant lubricating layer coating solution-3. In Example 6, average values α and β of the root-mean-square deviation Sq of the heat-resistant lubricating layer 40 were at α=0.386 and β=0.673, respectively.

| <Heat-resistant lubricating layer coating solution-3> | |
|---|---|
| Acrylic polyol resin (solid content 50%) | 20 parts |
| Phosphate ester melting point 15° C. | 2 parts |
| Phosphate ester melting point 70° C. | 2 parts |
| Zinc stearate melting point 115-125° C. | 2 parts |
| Talc particle size 2.5 μm | 3 parts |
| Talc particle size 3.5 μm | 5 parts |
| 2,6-Tolylene diisocyanate prepolymer | 5 parts |
| Toluene | 46 parts |
| Methyl ethyl ketone | 20 parts |
| Ethyl acetate | 5 parts |

COMPARATIVE EXAMPLE 1

The same dye layer formation coating solution as in Example 1 was coated onto an easy-to-adhesion treatment surface of a base material having a heat-resistant lubricating layer without formation of an undercoating layer according to a gravure coating method in such a way that a dry coating amount was 0.60 g/m$^2$, followed by drying at 90° C. for one minute to form a dye layer thereby obtaining a heat-sensitive transfer recording medium of Comparative Example 1. In Comparative Example 1, average values α and β of the root-mean-square deviation Sq of the heat-resistant lubricating layer 40 were at α=0.063 and β=0.078, respectively.

COMPARATIVE EXAMPLE 2

A heat-sensitive transfer recording medium of Comparative Example 2 was obtained in the same way as Example 1 except that the undercoating layer in the heat-sensitive transfer recording medium prepared in Example 1 was formed using an undercoating layer coating solution-3 having the following composition. In Comparative Example 2, average values α and β of the root-mean-square deviation Sq of the heat-resistant lubricating layer 40 were at α=0.060 and β=0.068, respectively. The equilibrium absorption rate of the undercoating layer at 23° C./50% was 30%.

| <Undercoating layer coating solution-3> | |
|---|---|
| Polyvinylpyrrolidone | 5.00 parts |
| Pure water | 57.0 parts |
| Isopropyl alcohol | 38.0 parts |

COMPARATIVE EXAMPLE 3

A heat-sensitive transfer recording medium of Comparative Example 3 was obtained in the same way as Example 1 except that the undercoating layer in the heat-sensitive transfer recording medium prepared in Example 1 was formed using an undercoating layer coating solution-4 having the following composition.

In Comparative example 3, average values α and β of the root-mean-square deviation Sq of the heat-resistant lubricating layer 40 were at α=0.063 and β=0.074, respectively. The equilibrium moisture absorption rate of the undercoating layer at 23° C./50% was 20%.

| <Undercoating layer coating solution-4> | |
|---|---|
| Polyvinyl alcohol | 1.50 parts |
| Polyvinylpyrrolidone | 3.50 parts |
| Pure water | 57.0 parts |
| Isopropyl alcohol | 38.0 parts |

COMPARATIVE EXAMPLE 4

A heat-sensitive transfer recording medium of Comparative Example 4 was obtained in the same way as Example 1 except that the undercoating layer in the heat-sensitive transfer recording medium prepared in Example 1 was formed using an undercoating layer coating solution-5 having the following composition. In Comparative Example 4, average values α and β of the root-mean-square deviation Sq of the heat-resistant lubricating layer 40 were at α=0.062 and β=0.075, respectively. The equilibrium moisture absorption rate of the undercoating layer at 23° C./50% was 30%.

| <Undercoating layer coating solution-5> | |
|---|---|
| Carboxymethylcellulose | 5.00 parts |
| Pure water | 57.0 parts |
| Isopropyl alcohol | 38.0 parts |

COMPARATIVE EXAMPLE 5

A heat-sensitive transfer recording medium of Comparative Example 5 was obtained in the same way as Example 1 except that the undercoating layer in the heat-sensitive transfer recording medium prepared in Example 1 was formed using an undercoating layer coating solution-6 having the following composition. In Comparative Example 5, the equilibrium moisture absorption rate of the undercoating layer under conditions of a temperature of 23° C. and a humidity of 50% was 3%. The equilibrium moisture absorption rate of the undercoating layer at 23° C./50% was 3%.

| <Undercoating layer-6> | |
|---|---|
| Polyamide elastomer | 5.00 parts |
| Pure water | 57.0 parts |
| Isopropyl alcohol | 38.0 parts |

COMPARATIVE EXAMPLE 6

A heat-sensitive transfer recording medium of Comparative Example 6 was obtained in the same way as Example 1 except that the heat-resistant lubricating layer 40 in the heat-sensitive transfer recording medium prepared in Example 1 was formed using a heat-resistant lubricating layer coating solution-4 having the following composition. In Comparative Example 6, average values α and β of the root-mean-square deviation Sq of the heat-resistant lubricating layer 40 were at α=0.462 and β=0.544, respectively.

| <Heat-resistant lubricating layer coating solution-4> | |
|---|---|
| Acrylic polyol resin (solid content 50%) | 20 parts |
| Phosphate ester melting point 15° C. | 2 parts |
| Phosphate ester melting point 70° C. | 2 parts |
| Zinc stearate melting point 115-125° C. | 2 parts |
| Talc particle size 3.5 μm | 2 parts |
| Talc particle size 5 μm | 3.5 parts |
| 2,6-tolylene diisocyanate prepolymer | 5 parts |
| Toluene | 46 parts |
| Methyl ethyl ketone | 20 parts |
| Ethyl acetate | 5 parts |

COMPARATIVE EXAMPLE 7

A heat-sensitive transfer recording medium of Comparative Example 7 was obtained in the same way as Example 1 except that the heat-resistant lubricating layer 40 in the heat-sensitive transfer recording medium prepared in Example 1 was formed using a heat-resistant lubricating layer coating solution-5 having the following composition. In Comparative Example 7, average values α and β of the root-mean-square deviation Sq of the heat-resistant lubricating layer 40 were at α=0.033 and β=0.045, respectively.

| <Heat-resistant lubricating layer coating solution-5> | |
|---|---|
| Silicone acrylate | 30.0 parts |
| MEK | 70.0 parts |

COMPARATIVE EXAMPLE 8

A heat-sensitive transfer recording medium of Comparative Example 8 was obtained in the same way as Example 1 except that the heat-resistant lubricating layer in the heat-sensitive transfer recording medium prepared in Example 1 was formed using a heat-resistant lubricating layer coating solution-6 having the following composition. In Comparative Example 8, average values α and β of the root-mean-square deviation Sq of the heat-resistant lubricating layer 40 were at α=0.164 and β=0.513, respectively.

| <Heat-resistant lubricating layer coating solution-6> | |
|---|---|
| Polyethylene resin (solid content 50%) | 15 parts |
| Phosphate ester melting point 15° C. | 1.5 parts |
| Phosphate ester melting point 70° C. | 1.5 parts |
| Zinc stearate melting point 115-125° C. | 2 parts |
| Talc particle size 1.0 μm | 1 part |
| Talc particle size 2.5 μm | 1 part |
| Toluene | 49.5 parts |
| Methyl ethyl ketone | 20 parts |
| Ethyl acetate | 5 parts |

<Preparation of a Transfer Object>

As a base material, a 188 μm thick white foamed polyethylene terephthalate film was used, and a coating solution for image-receiving layer having the following composition was coated onto one surface thereof by a gravure coating method in such a way that a dry coating amount was 5.0 g/m$^2$, followed by drying to provide a transfer object for heat-sensitive transfer.

| <Coating solution for image receiving layer> | |
|---|---|
| Vinyl chloride-vinyl acetate-vinyl alcohol copolymer | 19.5 parts |
| Amino-modified silicone oil | 0.5 parts |
| Toluene | 40.0 parts |
| Methyl ethyl ketone | 40.0 parts |

<Evaluation of Print>

Using the heat-sensitive transfer recording mediums of Examples 1-6 and Comparative Examples 1-8, printing was carried out by use of a thermal simulator. The results of evaluating a low-density area and a maximum reflection density are shown in Table 1. It will be noted that the maximum reflection density means a value obtained by measuring, with X-Rite 528, a print portion where no matting was recognized on a print surface. As to the low-density area, the results of measurement of a reflection density at 23-26 tones selected after division of 255 tone, corresponding to the maximum reflection density, into 11 levels. The reflection density is a value measured with X-Rite 528.

Printing conditions are indicated below.

Printing environment: 23° C./50% RH

Line period: 0.7 msec

Printing resolution: horizontal scanning 300 dpi vertical scanning 300 dpi

<Evaluation of Abnormal Transfer>

The abnormal transfer was evaluated according to the following standards. ΔO or better indicates a level at which no problem occurs in practical use.

O: No abnormal transfer to the transfer object was recognized.

ΔO: Abnormal transfer to the transfer object was very slightly recognized.

Δ: Abnormal transfer to the transfer object was slightly recognized.

X: Abnormal transfer to the transfer object was recognized throughout the surface.

<Evaluation of the Print Surface>

Evaluation of matting of the print surface was made according to the following standards.

O: No matting was recognized.

Δ: Matting was recognized locally.

X: Matting was recognized clearly.

From the results shown in Table 1, it was found that the heat-sensitive transfer recording mediums of Examples 1-6 and Comparative Examples 2-4 and 6-8, in which the undercoating layer containing a water-soluble polymer as a main component was provided, showed higher transfer sensitivity in high-speed printing than the heat-sensitive transfer recording mediums of Comparative Example 1 having no undercoating layer and Comparative Example 5 which did not contain any water-soluble polymer as a main component. Further, it will be seen from the maximum reflection densities of Example 1 and Comparative Examples 2, 4 that polyvinyl alcohol is more preferred as a water-soluble polymer.

With Examples 1-6 and Comparative Examples 4-8 wherein the equilibrium moisture absorption rate under 23°

TABLE 1

| | Coating amount of undercoating layer after drying [g/m$^2$] | Equilibrium moisture absorption of undercoating layer (23° C./50%) | Root-mean-square deviation Sq: α | Root-mean-square deviation Sq: β | Difference between α and β |
|---|---|---|---|---|---|
| Example 1 | 0.20 | 8% | 0.057 | 0.072 | 0.015 |
| Example 2 | 0.20 | 14% | 0.058 | 0.068 | 0.010 |
| Example 3 | 0.03 | 8% | 0.060 | 0.070 | 0.010 |
| Example 4 | 0.35 | 8% | 0.058 | 0.077 | 0.019 |
| Example 5 | 0.20 | 8% | 0.175 | 0.265 | 0.090 |
| Example 6 | 0.20 | 8% | 0.386 | 0.673 | 0.287 |
| Comparative example 1 | — | — | 0.063 | 0.078 | 0.015 |
| Comparative example 2 | 0.20 | 30% | 0.060 | 0.068 | 0.008 |
| Comparative example 3 | 0.20 | 20% | 0.063 | 0.074 | 0.011 |
| Comparative example 4 | 0.20 | 30% | 0.062 | 0.075 | 0.014 |
| Comparative example 5 | 0.20 | 3% | 0.066 | 0.072 | 0.006 |
| Comparative example 6 | 0.20 | 8% | 0.462 | 0.544 | 0.082 |
| Comparative example 7 | 0.20 | 8% | 0.033 | 0.045 | 0.012 |
| Comparative example 8 | 0.20 | 8% | 0.164 | 0.513 | 0.349 |

| | Reflection density | | | | | Presence or |
|---|---|---|---|---|---|---|
| | Low density area | | Maximum reflection density | Abnormal | Presence or absence of matting of | absence of print failure due to |
| | 23/255 | 46/255 | 255/255 | transfer | print surface | wrinkles |
| Example 1 | 0.15 | 0.22 | 2.56 | ΔO | O | O |
| Example 2 | 0.15 | 0.22 | 2.51 | O | O | O |
| Example 3 | 0.16 | 0.23 | 2.59 | Δ | O | O |
| Example 4 | 0.12 | 0.20 | 2.48 | ΔO | O | O |
| Example 5 | 0.15 | 0.23 | 2.51 | OΔ | O | O |
| Example 6 | 0.16 | 0.21 | 2.51 | OΔ | O | O |
| Comparative example 1 | 0.15 | 0.22 | 1.85 | O | O | O |
| Comparative example 2 | 0.14 | 0.21 | 2.11 | O | X | O |
| Comparative example 3 | 0.15 | 0.22 | 2.36 | O | X | O |
| Comparative example 4 | 0.13 | 0.20 | 1.95 | X | X | O |
| Comparative example 5 | 0.15 | 0.22 | 1.87 | O | O | O |
| Comparative example 6 | 0.14 | 0.20 | 2.51 | OΔ | O | X |
| Comparative example 7 | 0.14 | 0.21 | 2.53 | OΔ | O | X |
| Comparative example 8 | 0.15 | 0.19 | 2.49 | OΔ | O | X |

C./50% was 15% or less, no phenomenon of local matting of the print surface was recognized. This was confirmed in Comparative Examples 2-4 wherein the equilibrium moisture absorption rate under 23° C./50% was 15% or over.

Further, when the heat-sensitive transfer recording medium of Example 3 wherein a coating amount of the undercoating layer was less than 0.10 g/m$^2$ was compared with the heat-sensitive transfer recording medium of Example 1, it was revealed that although transfer sensitivity at low tone areas was improved, the adhesiveness lowered to some extent. Moreover, when the heat-sensitive transfer recording medium of Example 4 wherein the amount of the undercoating layer exceeded 0.30 m$^2$ was likewise compared with the heat-sensitive transfer recording medium of Example 1, it was found that transfer sensitivity at low density areas lowered.

INDUSTRIAL APPLICABILITY

The heat-sensitive transfer recording medium obtained according the invention can be used for sublimation transfer type printers, and can be widely applied to for self-service printing, cards such as an identification card, an output object for amusements and so on, because various images can be formed in full color simply with the aid of high-speed and high-performance of printers.

EXPLANATION OF REFERENCE NUMERALS

10 base material
20 undercoating layer
30 dye layer
40 heat-resistant lubricating layer
100 base material
200 heat-insulating layer
300 receiving layer

What is claimed is:

1. A heat-sensitive transfer recording medium comprising:
a base material,
a heat-resistant lubricating layer formed on one surface of the base material,
an undercoating layer formed on the other surface of the base material, and a dye layer formed on a surface, opposite to a surface facing to the base material, of the undercoating layer,
wherein the undercoating layer comprises a water-soluble polymer as a main component, and an equilibrium moisture absorption rate of the undercoating layer at a temperature of 23° C. and a humidity of 50% is about 15% or less.

2. The heat-sensitive transfer recording medium of claim 1, wherein the equilibrium moisture absorption rate of the undercoating layer at a temperature of 23° C. and a humidity of 50% is about 13% or less.

3. The heat-sensitive transfer recording medium of claim 1, wherein an average α of surface roughness (root-mean-square deviation Sq) of the heat-resistant lubricating layer is about 0.05-0.40 μm, an average β of surface roughness (root-mean-square deviation Sq) of the heat-resistant lubricating layer after standing under conditions of 150° C. and ten minutes is about 0.00-0.70 μm, and a difference between the average α and the average β is about 0.00-0.30 μm.

4. The heat-sensitive transfer recording medium of claim 1, wherein a dry coating amount of the undercoating layer is about 0.05-0.30 g/m$^2$.

5. The heat-sensitive transfer recording medium of claim 1, wherein at least one layer on a side to be transferred of a transfer object is formed by an aqueous coating solution.

6. The heat-sensitive transfer recording medium of claim 1, wherein a total mass % of water-soluble polymers is greater than 50 mass % as a whole of the undercoating layer.

7. The heat-sensitive transfer recording medium of claim 1, wherein a total mass % of water-soluble polymers is at 80 mass % as a whole of the undercoating layer.

8. A method for producing a heat-sensitive transfer recording medium of a type which is used for a transfer object wherein at least one layer at a side to be transferred of the transfer object is formed with an aqueous coating solution and which includes a film-shaped or sheet-shaped base, a heat-resistant lubricating layer formed on one surface of the base, an undercoating layer formed on the other base surface opposite to the heat-resistant lubricating layer, and a dye layer formed on the undercoating layer, comprising the steps of:
(a) coating an undercoating layer-forming solution comprising a water-soluble polymer as a main component onto a base surface opposite to the heat-resistant layer; and,
(b) drying the undercoating layer-forming solution in such a way that an equilibrium moisture absorption rate of the undercoating layer at a temperature of 23° C. and a humidity of 50% is about 15% or less.

9. The method of claim 8, wherein the undercoating layer is dried in such a way that theequilibrium moisture absorption rate at a temperature of 23° C. and a humidity of 50% is about 13% or less.

10. The method of claim 8, wherein the undercoating layer-forming solution containing the water-soluble polymer as the main component is coated onto the base surface opposite to the heat-resistant layer in such a way that a dry coating amount of the undercoating layer-forming solution is from not less than 0.05 g/m$^2$ to not larger than 0.30 g/m$^2$, and
wherein the undercoating layer-forming solution is subsequently dried.

11. A heat-sensitive transfer recording method, comprising the steps of:
(a) providing a base material;
(b) forming a heat-resistant lubricating layer formed on one surface of the base material;
(c) forming an undercoating layer formed on the other surface of the base material, the undercoating layer comprising a water-soluble polymer as a main component, and with an equilibrium moisture absorption rate of the undercoating layer at a temperature of 23° C and a humidity of 50% that is about 15% or less;
(d) forming a dye layer formed on a surface of the undercoating layer, opposite to a surface facing to the base material, with the dye being sublimated by application of heat; and,
(e) transferring the dye to a transfer object with the application of heat.

* * * * *